US006938563B2

(12) United States Patent
Martin et al.

(10) Patent No.: US 6,938,563 B2
(45) Date of Patent: Sep. 6, 2005

(54) GRATE FURNACE

(75) Inventors: Johannes Martin, München (DE); Peter Weber, München (DE); Werner Familler, München (DE)

(73) Assignee: Martin GmbH Für Umwelt-und Energietechnik, Munich (DE)

( * ) Notice: Subject to any disclaimer, the term of this patent is extended or adjusted under 35 U.S.C. 154(b) by 0 days.

(21) Appl. No.: 10/714,081

(22) Filed: Nov. 14, 2003

(65) Prior Publication Data

US 2004/0231573 A1 Nov. 25, 2004

Related U.S. Application Data

(63) Continuation-in-part of application No. 10/210,156, filed on Aug. 1, 2002, now abandoned.

(30) Foreign Application Priority Data

Aug. 1, 2001 (DE) ..... 101 37 520

(51) Int. Cl.[7] ..... F23K 3/00; F23H 11/20
(52) U.S. Cl. ..... 110/327; 110/286; 126/169
(58) Field of Search ..... 126/169, 175, 126/152 B; 110/285, 268, 278, 280, 281, 282, 286, 291, 288, 328, 248, 255, 327, 101 R

(56) References Cited

U.S. PATENT DOCUMENTS

| | | | | | |
|---|---|---|---|---|---|
| 1,633,418 | A | * | 6/1927 | Priebe et al. | 110/328 |
| 2,230,833 | A | * | 2/1941 | Douglass | 432/7 |
| 4,172,425 | A | * | 10/1979 | Sheridan | 110/257 |
| 4,534,301 | A | * | 8/1985 | Sakash et al. | 110/255 |
| 4,895,084 | A | * | 1/1990 | Kroon et al. | 110/255 |
| 5,694,868 | A | * | 12/1997 | Mitthof | 110/210 |
| 6,024,031 | A | * | 2/2000 | Stiefel | 110/281 |

FOREIGN PATENT DOCUMENTS

| | | | |
|---|---|---|---|
| DE | 461849 | * | 6/1928 |
| DE | 911316 | * | 7/1949 |

* cited by examiner

*Primary Examiner*—Kenneth Rinehart
(74) *Attorney, Agent, or Firm*—Cohen, Pontani, Lieberman & Pavane

(57) ABSTRACT

A grate furnace with a grate includes grate steps made of grate elements lying next to one another. Every second grate step in the longitudinal direction of the grate can be driven for carrying out stoking movements and the grate steps in each case lying therebetween are stationary. Drive devices for driving the moveable grates are arranged in housing chambers and are in this way protected against impairment caused by material falling through the grate. A certain section of the housing chamber is open toward the bottom so that it is accessible even during operation of the grate furnace.

11 Claims, 4 Drawing Sheets

GRATE FURNACE

PRIORITY CLAIM

This is a Continuation-in-Part of U.S. patent application Ser. No. 10/210,156 which was filed Aug. 1, 2002 now abandoned. Priority is claimed on that application under 35 U.S.C. §120. Priority is also claimed on the following foreign application under 35 U.S.C. §119, Country: Germany, Application No.: 101 37 520.4, Filed: Aug. 1, 2001.

BACKGROUND OF THE INVENTION

1. Field of the Invention

The invention relates to a grate furnace with a grate having grate steps including grate elements lying next to one another, every second grate step in the longitudinal direction of the grate can be driven for carrying out stoking movements and the grate steps in each case lying therebetween are stationary, the drive devices for the movable grate steps being arranged under the grate.

2. Description of the Prior Art

Known grates of grate furnaces with alternately arranged fixed and movable grate steps had a continuous stepped beam under the grate, to which beam the grate steps to be moved were connected and which beam had a single drive. In this connection, it was possible to arrange the drive device for this beam outside the grate, so that this drive device was not impaired by hot materials falling through the grate.

With the endeavor to influence the combustion process on the grate in a still better way, the approach changed to providing separate drive devices in each case for individual or grouped-together movable grate steps. In a first variant, these devices were then located at the side next to the actual grate module, which complicated or made more difficult a multiple-path arrangement of these grate modules next to one another and required drive linkages which were difficult to seal. When, according to a second variant, the drive devices were located under the grate, there were always disadvantageous consequences when hot materials came through the grate. If hot and perhaps sticky materials in liquid form drip onto the piston rods of cylinder/piston units and solidify there, this then leads very rapidly to the piston rod seal being damaged and thus to the failure of this drive device. The consequence of the failure of a drive device is the relatively long-term shutdown of the grate furnace.

SUMMARY OF THE PRESENT INVENTION

It is an object of the invention to produce a grate furnace which both makes possible an arrangement of the drives under the grate which is as simple as possible and protected against material falling through the grate, and also allows maintenance and/or replacement of the drive devices during continuous operation.

This task is accomplished according to the invention in a grate furnace of the type explained above in that the drive devices are protected by housings, a first longitudinal section of each housing being completely enclosed within the under-grate blast chamber, whereas a second longitudinal section is only partially enclosed and sealed by the under-grate blast chamber, so that, in this second section, the housing is open toward the bottom and freely accessible from underneath.

According to the invention, this object is achieved in a grate furnace of the type described in the introduction by virtue of the fact that the drive devices are arranged under the grate, protected by housings. Another essential advantage is that it is possible to enter these housings from below, so that maintenance work can be performed on the drive devices or so that the devices can be replaced. The reason why this advantage is so important is that the drive devices can be accessed without shutting down the grate furnace and without turning off the underblast blower. The invention therefore makes it possible to maintain and to repair the drive devices even while the grate furnace is operating normally.

By virtue of this embodiment according to the invention, the drive devices are protected against everything which may enter the underblast chamber from above through the grate.

In a further advantageous embodiment, a separate housing chamber, which makes possible assembly or exchange of the drive device during continuous operation, is provided for each drive device.

An additional protection for the drive devices is achieved in a further embodiment of the invention by virtue of the fact that each housing is thermally insulated. This proves to be advantageous especially when the primary air sweeping past the housing in the underblast chamber is very greatly preheated. In order further to increase the effect achieved by the thermal insulation, forced ventilation can be provided for each housing in a development of the invention.

In order to a great extent to avoid disruption in the primary air supply in connection with an increased flow resistance, provision is advantageously made that the housing chamber is of streamlined design in the flow direction of the primary air supplied for the grate furnace in at least one underblast chamber.

In order on the one hand to create favorable installation conditions for the drive device in each housing chamber and on the other hand to achieve good adaptation to the grate inclination in the case of several housing chambers arranged one behind the other, provision is made in a further advantageous embodiment of the invention that successive housing chambers are staggered in relation to one another in a stepped manner following the grate inclination.

Although one drive device can in principle be provided for one or more grate steps to be moved, it has been found to be advantageous if a drive device is in each case assigned to two movable grate steps. A stationary grate step is then located between these two movable grate steps, in which way the smallest controllable grate unit is created.

An especially advantageous embodiment of the invention consists in that each drive device comprises at least one hydraulic cylinder/piston unit, the piston rod of which is connected to a push rod which is guided in a sealed manner through the housing wall and acts on a carriage, to which at least one grate step to be moved is connected. The use of a push rod between a carriage guided on guides and the piston rod of the drive cylinder has the advantage that the particularly finely machined surface of the piston rod always remains in the protective housing, so that there is no risk of the seal of the working cylinder being damaged by impairment of the piston rod. Damage to the seal on the housing, which may occur as a result of deposits on the push rod, do not then have any serious consequences as may occur in the event of damage to the seal of the working cylinder.

In order to compensate tolerances in the connection between the working cylinder and the carriage, which may arise as a result of the manufacture of the various parts, assembly and also thermal action, provision is made in an advantageous development of the invention that the piston rod is connected to the push rod by an articulation.

The stepped arrangement described above of the individual housings affords the prerequisite for a further advantageous embodiment of the invention, which consists in that the carriages are guided on guide tracks which run parallel to the movement paths of the movable grate steps and are in each case arranged above a housing of an adjacent drive arrangement.

When, in an another advantageous embodiment of the invention, each housing is connected to its assigned under-grate blast chamber by an opening which can be sealed with a flap, it is possible to turn off the under-grate blast and to gain access to the under-grate blast chambers, so that maintenance work or repair work can be conducted either on the slide blocks driven by the drive device or on some other part of the machinery.

BRIEF DESCRIPTION OF THE DRAWINGS

The invention is explained in greater detail below with reference to an illustrative embodiment. In the drawing.

DETAILED DESCRIPTION OF THE PREFERRED EMBODIMENTS

Figure 1:
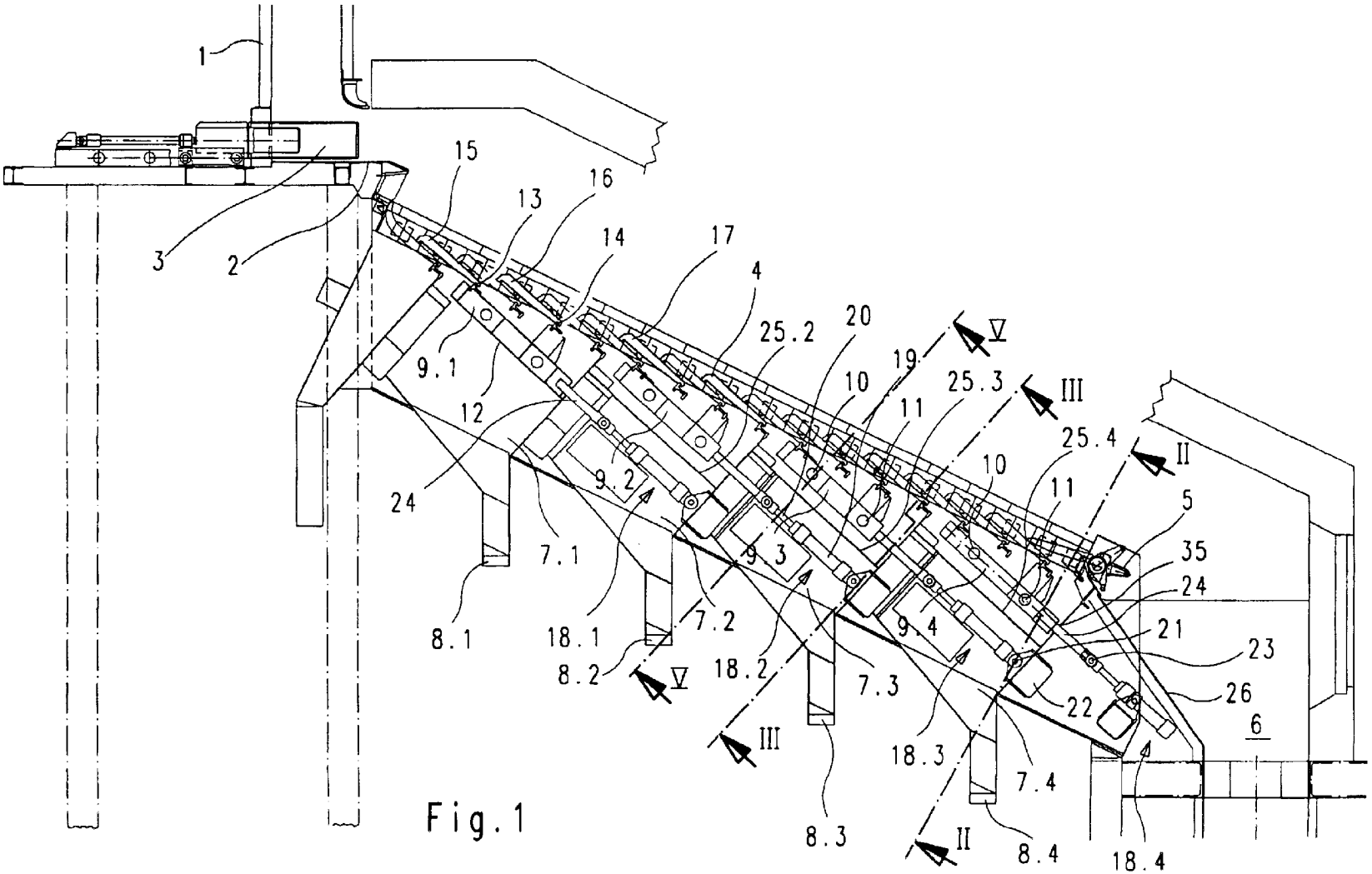
FIG. 1 is a longitudinal sectional view of a grate furnace.

A grate furnace according to FIG. 1 comprises a charging hopper 1, a charging device 3 which can move to and fro over a charging table 2, a grate 4, a collecting device 5 arranged at the end of the grate for collecting the ash, and an ash chute 6 into which the burnt ash falls.

Situated under the grate 4 are four mutually separate underblast chambers 7.1, 7.2, 7.3 and 7.4. These underblast chambers each have connections 8.1 to 8.4 for the separate supply of primary air, which is blown toward the grate 4 from the underside and through the grate into the fuel lying on the grate, for example refuse.

The underblast chambers are arranged in a stepped staggered manner in relation to one another following the inclined grate 4. Arranged above each underblast chamber is a carriage 9.1 to 9.4 which, as can be seen in connection with FIG. 3 in particular, is in each case provided with two roller pairs 10 and 11 which are guided in guide tracks 12. Arranged on each carriage are drivers 13 and 14, each of which is in engagement with a movable grate step 15 and, respectively, 16. The furnace grate is composed of in each case alternately movable and stationary grate steps, a stationary grate step 17 being provided in each case between two movable grate steps 15 and 16. A carriage 9 is therefore provided for the motive drive of two movable grate steps. The guide tracks 12 are aligned parallel to the movement direction of the movable grate steps 15 and 16.

A drive device designated as a whole by reference number 18, which comprises a working cylinder 19, a piston (not shown in the drawing) which is movable in the working cylinder, and a piston rod 20, serves for displacing each carriage 9 and the grate steps 15 and 16 connected thereto. The working cylinder 19 is fastened to a transverse beam 22 by means of an articulation arrangement 21, while the piston rod 20 is connected via an articulation 23 to a push rod 24 which extends through a seal 35 of a housing to be described below.

Each drive device, with the exception of the drive device 18.4 which serves for the drive of the last two movable grate steps just before the ash chute, is arranged in a housing 25 which is continuous in the illustrative embodiment and is divided into housing chambers which are designated by reference numbers 25.2 to 25.4 below. These housing chambers 25, which can be seen from FIGS. 2 and 3 in particular, surround the drive devices 18.1, 18.2 and 18.3 in a protective manner. The drive arrangement 18.4 is situated under a fee hopper 26 for the ash chute 6 and is consequently located outside the grate region, for which reason a housing chamber is not provided for this drive.

Figure 2:
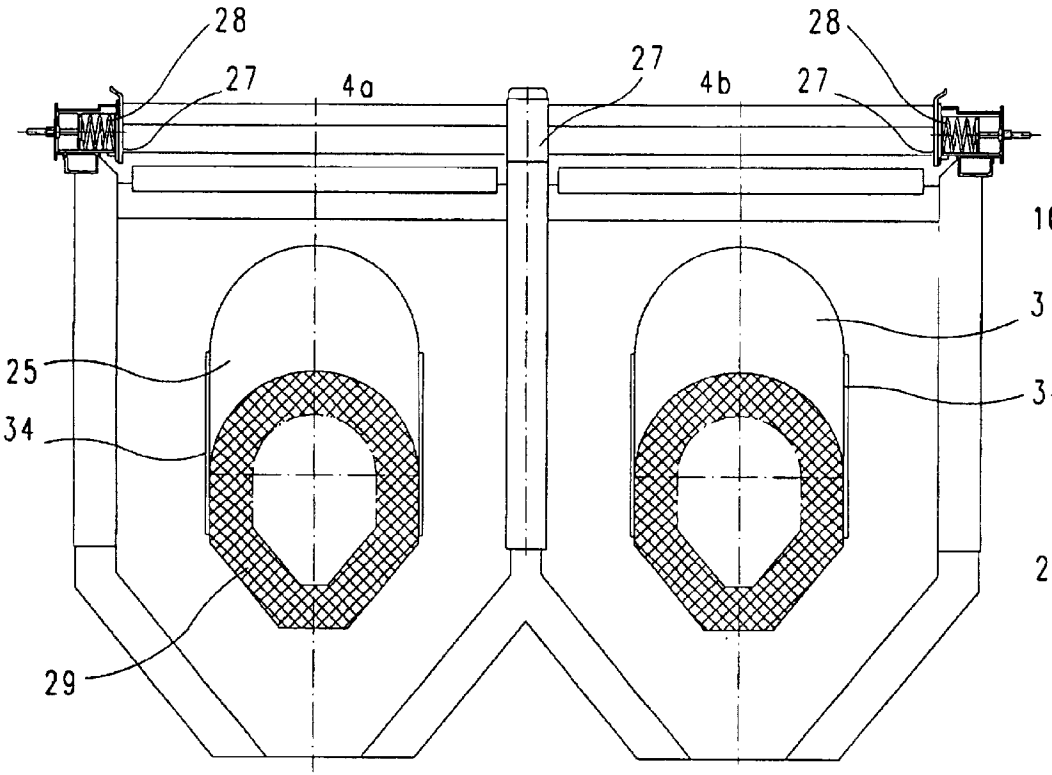
FIG. 2 shows a section along the line II—II in FIG. 1.
Figure 4:
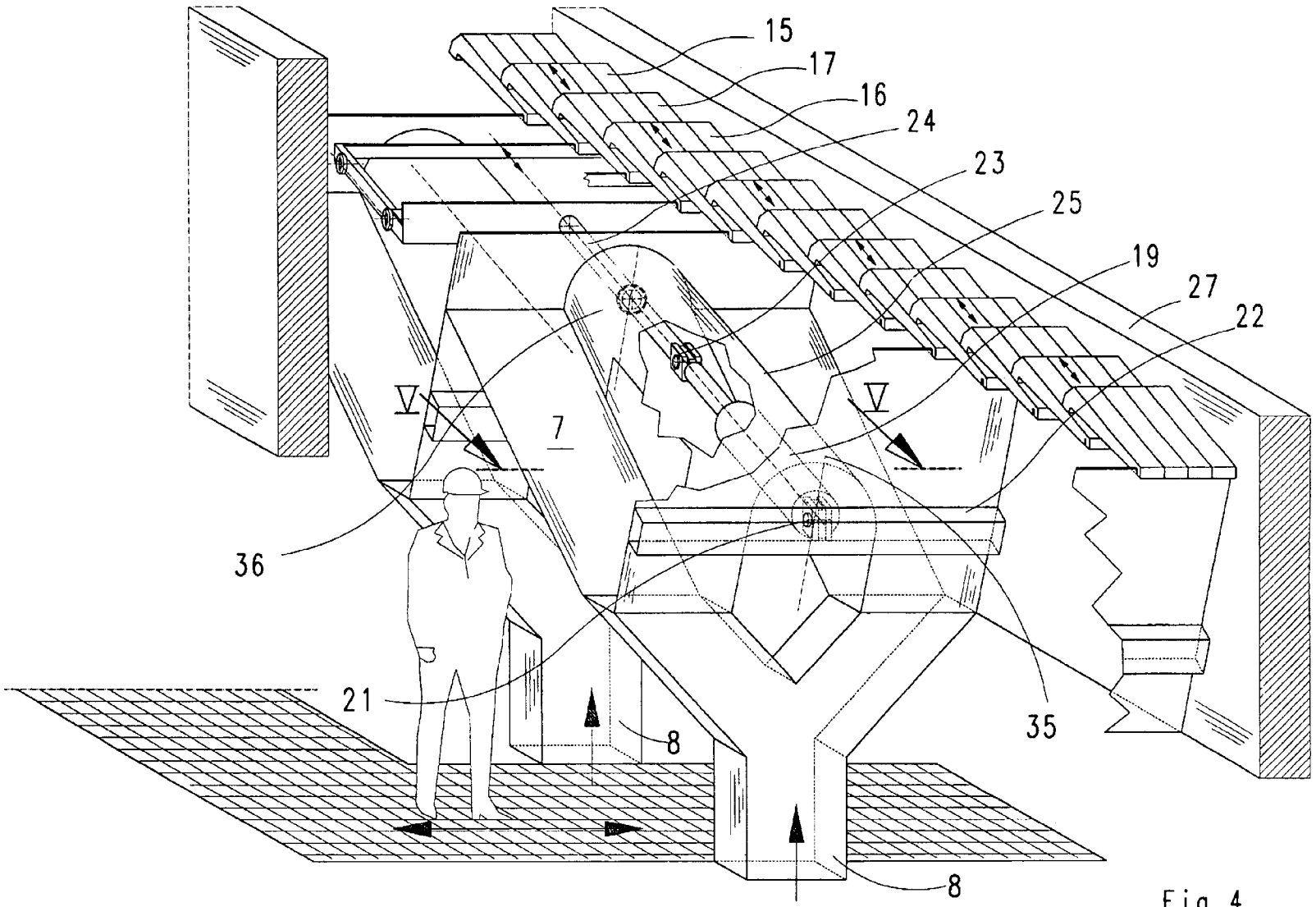
FIG. 4 is a partially cross sectional schematic view of the grate furnace.

As can be seen from FIG. 2, the grate furnace illustrated in the drawing has two grate paths next to one another, which are designated by reference numbers 4*a* and 4*b*. The grate paths concerned are situated between lateral pressing plates 27 which are loaded by spring arrangements 28 in order to be capable of compensating lateral thermal expansion of the grate paths. The housing chambers 25 for accommodating the drive devices 18 have thermal insulation 29 and forced ventilation, the corresponding ducts for the forced ventilation not being shown in the drawing. Flaps 31 articulated by means of an articulation 30 make possible assembly and maintenance of the drivable slide blocks 9 and the pushrods 24.

Figure 3:
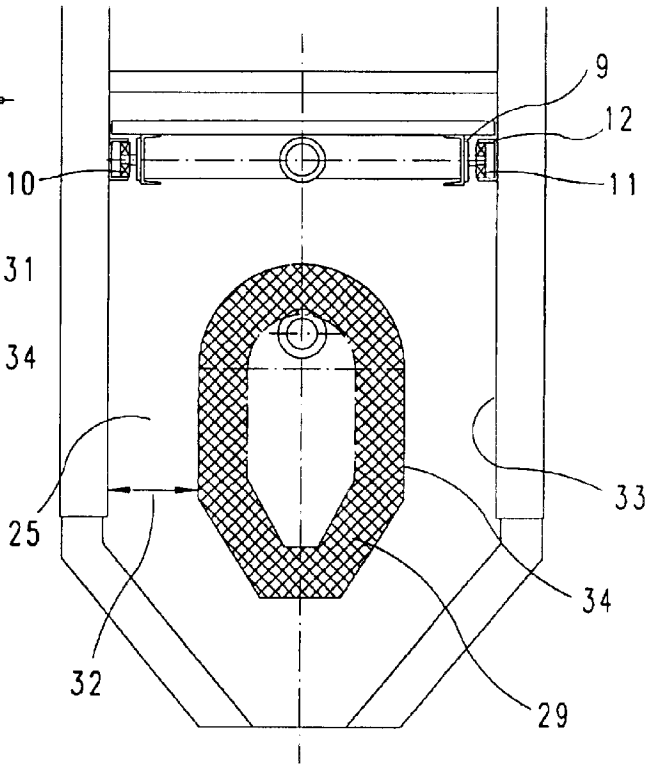
FIG. 3 shows a part section along the line III—III in FIG. 1.

As can be seen from FIGS. 2 and 3, the housings 25 concerned are of streamlined design and configured and arranged in such a manner that an essentially constant flow cross section 32 remains in each case between the inner wall 33 of an underblast chamber 7 and the outer wall 34 of the housing 25.

Figure 5:
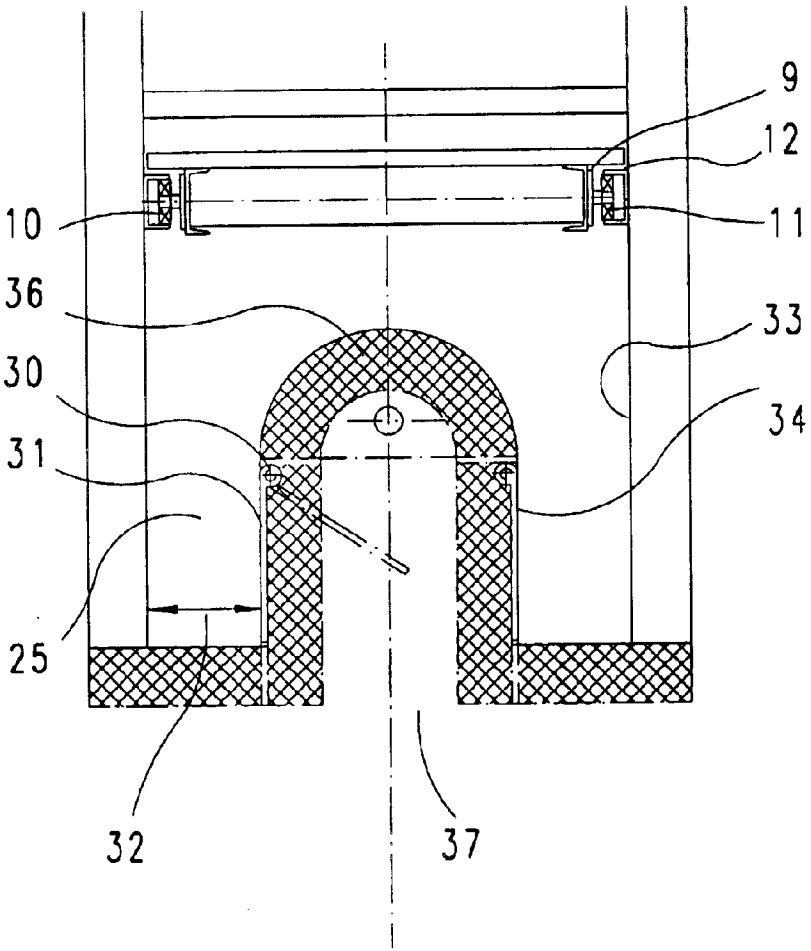
FIG. 5 shows a cross section along line V—V of the grate furnace of FIG. 4.

Each of the individual housings 25 has a first longitudinal section 35 in the area of the cross-sectional lines II—II and III—III, which is completely enclosed by the under-grate blast chamber 7, as can be seen in the cross-sectional diagrams in FIGS. 2 and 3. In addition, each of these housings 25 has a second longitudinal section 36, which is only partially enclosed by the under-grate blast chamber 7 and which is freely accessible from below, this open area being designated 37. This possibility of access to the area 37, which is open toward the bottom, makes it possible to perform repair and maintenance work on the drive device 18. As is especially clear in FIG. 5, the flap 31 can be pivoted inward around the joint 30 to allow access to the under-grate blast chamber 7, thus making it possible for repair and maintenance work to be performed on the slide blocks 9.

What is claimed is:

1. A grate furnace, comprising:

a grate including a plurality of movable grate steps movable in a longitudinal direction of said grate in a stoking movement direction, said grate further comprising at least one stationary grate step between every longitudinally adjacent pair of said movable grate steps;

drive devices respectively arranged in areas of underblast chambers under said grate for moving said moveable grate steps; and a housing corresponding to each of the underblast areas, each housing corresponding to one of said drive devices for protecting said drive devices and arranged between said drive devices and said grate, each of said housings comprising a separate housing chamber for each of said drive devices arranged under said grate, each of said housings comprising a first longitudinal section and a second longitudinal section, said first longitudinal section being enclosed in the underblast chamber and said second longitudinal section being partially enclosed in the underblast chamber and being open toward a bottom such that said second longitudinal area is accessible from underneath.

2. The grate furnace of claim 1, wherein each said separate housing chambers comprises thermal insulation.

3. The grate furnace of claim 1, wherein each said separate housing chambers receives forced ventilation.

4. The grate furnace of claim 1, wherein said underblast chamber supplies primary air to said grate in a flow direction, said housing being streamlined relative to said flow direction.

5. The grate furnace of claim 1, wherein said grate comprises a grate inclination and said housing chambers are staggered relative to each other relative to said grate inclination.

6. The grate furnace of claim 1, wherein each of said drive devices is connected to two of said moveable grate steps.

7. The grate furnace of claim 1, wherein each of said drive devices comprises at least one hydraulic cylinder/piston unit including a piston rod, a push rod connected to said piston rod, and a carriage connected to at least one moveable grate step, wherein said push rod is sealingly guided through a wall of said housing.

8. The grate furnace of claim 7, wherein said piston rod is connected to said push rod by art articulation.

9. The grate furnace of claim 7, wherein said each of said drive devices further comprises guide tracks running parallel to said stoking movement direction for guiding said carriage, said housing comprising separate housing chambers for each of said drive devices, and said guide tracks being arranged above said housing chamber of an adjacent one of said drive devices.

10. The grate furnace of claim 1, wherein said housing is connected to the underblast chamber by an opening, said housing comprising a flap for selectively closing said opening.

11. A grate furnace, comprising:

a grate including a plurality of movable grate steps movable in a longitudinal direction of said grate in a stoking movement direction, said grate further comprising at least one stationary grate step between every longitudinally adjacent pair of said movable grate steps;

an underblast enclosure defining an underblast chamber for directing air toward said grate;

drive devices proximate said underblast chamber under said grate arranged and dimensioned for moving said moveable grate steps; and a housing arranged for protecting said drive devices arranged between said drive devices and said grate, said housing comprising a first longitudinal section and a second longitudinal section, said first longitudinal section of said housing being surrounded by said underblast enclosure and said second longitudinal section being partially surrounded by said underblast enclosure and such that said second longitudinal area is open toward the bottom, said second longitudinal section being sufficiently open toward the bottom for allowing access to said drive devices for maintenance and replacement of said drive devices.

* * * * *